United States Patent [19]

Triebel et al.

[11] Patent Number: 4,559,472

[45] Date of Patent: Dec. 17, 1985

[54] HIGH-PRESSURE DISCHARGE LAMP HAVING SUPPORT STRUCTURES FOR THE ELONGATE ELECTRODES THEREOF

[75] Inventors: Walter Triebel; Heinz Bunke, both of Eichstätt, Fed. Rep. of Germany

[73] Assignee: Patent Treuhand Gesellschaft fur elektrische Glühlampen mbH, Munich, Fed. Rep. of Germany

[21] Appl. No.: 464,385

[22] Filed: Feb. 7, 1983

[30] Foreign Application Priority Data

Feb. 16, 1982 [DE] Fed. Rep. of Germany ..... 3205401

[51] Int. Cl.[4] ..... H01J 61/073; H01J 61/36

[52] U.S. Cl. ..... 313/623; 313/631; 313/335

[58] Field of Search ..... 313/631–632, 313/623–625, 335

[56] References Cited

U.S. PATENT DOCUMENTS

| | | | |
|---|---|---|---|
| 3,140,417 | 7/1964 | Tietze | 313/256 X |
| 4,038,578 | 7/1977 | Mathijssen | 313/253 X |
| 4,463,281 | 7/1984 | Triebel et al. | 313/623 |

*Primary Examiner*—Palmer C. DeMeo
*Assistant Examiner*—Sandra L. O'Shea
*Attorney, Agent, or Firm*—Frishauf, Holtz, Goodman & Woodward

[57] ABSTRACT

A high-pressure discharge lamp having a glass enclosure defining a discharge space and envelope portions extending away from the discharge space is provided with elongate electrode portions extending respectively through the envelope portions. These electrode portions carry respective electrode portions at their inner ends and the electrode portions are sealed hermetically to the respective envelope portions. In order to support the electrode portions within the envelope portions, respective support elements are fitted around the electrode portions in spaced relation to the envelope portions and means, including a respective resilient element engaging each support member, are provided to hold the support elements in their axial position around the respective electrode portions. The resilient elements are each held between the respective electrode and the inner surface of the respective support element to continuously urge the axially outer surface of the support element resiliently against the respective sealing means.

20 Claims, 2 Drawing Figures

HIGH-PRESSURE DISCHARGE LAMP HAVING SUPPORT STRUCTURES FOR THE ELONGATE ELECTRODES THEREOF

Reference to related publications: U.S. Pat. No. 3,140,417; U.S. Pat. No. 4,038,578.

The present invention relates to a high-pressure discharge lamp, and more particularly, to such a lamp in which elongate electrodes extend into a discharge space of the lamp and are securely supported.

BACKGROUND

High pressure discharge lamps typically include elongate electrodes extending into a discharge space formed by a glass enclosure. The discharge space includes a rare gas and the electrodes form respectively a cathode and an anode spaced from one another within the discharge space, as is well understood in the art. The electrodes lead outwardly from the glass enclosure and must be sealed hermetically thereto. Since the cathode and anode are held at the free end portions of the elongate electrodes, the weight of the electrodes may tend to damage the hermetic seal to the glass enclosure. Accordingly, elements are often provided to support the electrodes, particularly in lamps operated by direct current.

In the U.S. Pat. No. 3,140,417, the elongate electrodes are made to pass through a sleeve of quartz glass. The glass enclosure of the lamp includes a neck portion which is heated to its softening temperature in the region adjacent the support sleeve and collapsed around the support sleeve to seal the support sleeve and the neck portion together. The support sleeve must be located accurately relative to the neck portion of the glass enclosure, and this tends to complicate assembly. Also, the heating of the neck portion to its softening temperature normally must be done with precision by highly qualified personnel, due to the specific properites of the materials involved. Supporting the electrodes in the manner disclosed in the patent noted above is, therefore, rather complicated and troublesome.

Support elements which are not fused with the glass envelope of the lamp have been proposed, for example as disclosed in U.S. Pat. No. 4,038,578, Mathijssen. In this patent, the support elements may be held in their proper position by deforming a portion of the glass envelope around the support element, or by locking the support element between locking members held to the electrode. Such arrangements, however, are rather cumbersome and also tend to complicate assembly.

Some of these drawbacks of the support elements proposed in the latter patent can be overcome by use of support elements of the type disclosed in U.S. Ser. No. 228,408, now U.S. Pat. No. 4,463,281, which corresponds to German Patent Disclosure Document DE-OS No. 30 29 824, which has a rounded edge pressed by a pressure spring against a constricted portion located between the glass envelope for the electrode and the discharge space. Again, however, such support elements are rather cumbersome to assemble in position.

THE INVENTION

It is an object of the present invention to arrange the support element in such a way that it can be held in its proper axial position relatively simply.

Briefly, in accordance with the present invention, a high-pressure discharge lamp having a glass enclosure defining a discharge space and envelope portions extending away from the discharge space is provided with elongate electrode portions extending respectively through the envelope portions. These elongate electrode portions carry at their inner end portions respective electrodes facing one another within the discharge space, and means are also provided for interconnecting outer end portions of the electrode portions and respective envelope portions of the glass enclosure for sealing the electrode portions hermetically within the envelope portions. In order to support the electrode portions within the envelope portions, respective support elements are fitted around each electrode portions in spaced relation to the envelope portions, and resilient retaining or locking means are provided which resiliently engage each support element, for holding the support elements in their axial positions around respective electrode portions.

As an important feature of the present invention, these resilient retaining locking elements are each held between a respective electrode and the inner surface of the respective support element, and urge the axially outer surface of respective supports element resiliently against a portion of the sealing means. In this way, the initial manufacturing or assembly does not require a heating step for securing the support elements in position, and the proper electrode spacing and positioning of the support elements can be attained easily.

The support elements may each be of a length sufficient to extend from the portion of the sealing means they engage all the way to the discharge space to isolate the respective envelope portions from the discharge space. The support elements may therefore be located easily in position during assembly of the lamp, and damaging or scraping of the inner surface of the envelope portion during assembly is largely prevented. Further, the volume of the glass enclosure that will be filled with the rare gas is considerably reduced. Additionally, the portions of the lamp behind the electrodes will constitute cold spots where any material evaporated from the electrodes may condense without having a negative influence on the illuminance of the lamp.

In one embodiment of the present invention, in the case of small lamps with low power input, the ratio of the length of each support member relative to its diameter remains constant along the length; whereby in a second embodiment of the present invention, a portion of the support element adjacent to the discharge space has a diameter larger than remaining portions of the support element. This second embodiment is particularly suited for lamps of higher power input. Further, it is preferred that the ratio of the length of the support member to its diameter be equal to at least one, and the support elements are preferably formed of material having a high melting point and a coefficient of thermal expansion similar to that for the material forming the glass enclosure. Materials particularly suited for this purpose are, e.g. quartz or ceramic. Also, the resilient elements are preferably formed of a material having a high melting point, preferably tungsten.

Drawings, illustrating embodiments of the present invention, wherein.

Figure 1:
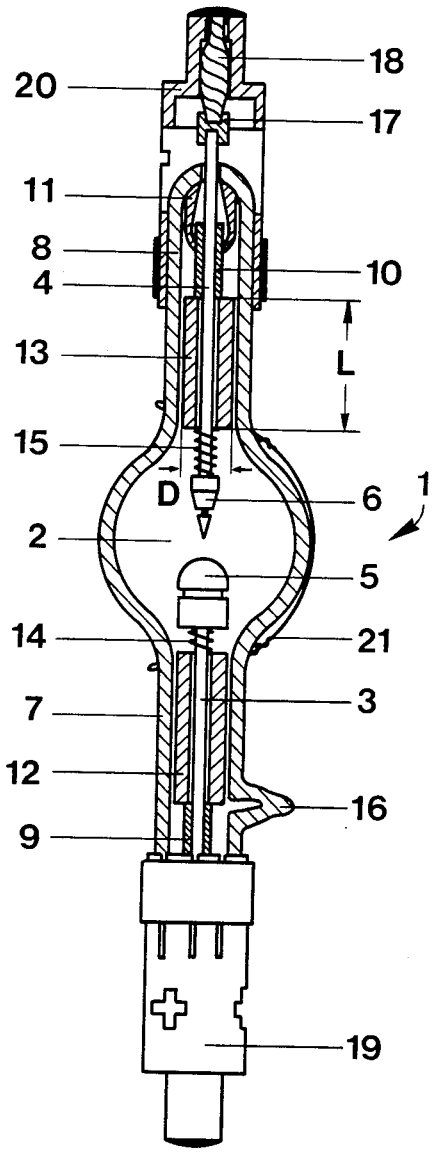
FIG. 1 illustrates diagrammatically one embodiment of a high-pressure discharge lamp according to the present invention, partially in section.

The high-pressure discharge lamp 1 shown in FIG. 1 includes a glass enclosure formed by quartz glass to define a generally globular discharge space 2 and cylindrical envelope portions 7 and 8. Extending concentrically within the envelope portions 7 and 8 are electrode portions 3 and 4 carrying, respectively, an anode 5 and a cathode 6 at their inner ends. The outer ends of the electrode portions 3 and 4 are sealed hermetically to the outer ends of the envelope portions 7 and 8. The hermetic seal comprises the glass members 9 and 10, respectively, a dome portion 11 shown only for the cathode electrode, and the ends of the envelope portions 7 and 8.

Support elements, each formed by respective tubular members 12 and 13, are fitted around the electrode portions 3, 4. The support elements are preferably also formed of quartz glass, but may be formed of a ceramic material, or the like, and have a diameter enabling a small clearance to be maintained between the support elements and the inner surface of the respective envelope portions. These support elements 12 and 13 are urged against the respective glass members 9 and 10 by a retaining element formed as a respective spiral compression spring 14 and 15 preferably formed of the same material as the electrode portions 3 and 4, that is tungsten. These springs 14 and 15 are arranged between the anode 5 and the cathode 6, respectively, and the respective support elements 12 or 13, as shown clearly in FIG. 1.

The support element 12 has a length L of about 25 mm, and the support element 13 has a length L of about 20 mm, and both support elements have a diameter D of about 7.5 mm. The ratio of the length L to diameter D of the support elements of the embodiment illustrated in FIG. 1 remains substantially constant over the entire length of the support element, that is for the support element, that is for the support element 12 on the anode side, this ratio is approximately 3.33; and for the support element 13 on the cathode side, the ratio is approximately 2.67. The electrode portion 4 extends externally from the hermetic seal and is connected by intermediate member 17 to a stranded lead-in wire 18, held in base 20, and base 19 connects an end portion of electrode portion 3 with appropriate electrical connectors. A starting wire 21 is passed along the discharge space 2 on the outside thereof and is wrapped around respective envelope portions 7 and 8. The high-pressure discharge lamp of FIG. 1 is typically charged with xenon gas to a pressure of about 10 bar through opening 16 which is later sealed, and is operated from a D.C. source with an input of approximately 500 W.

Figure 2:
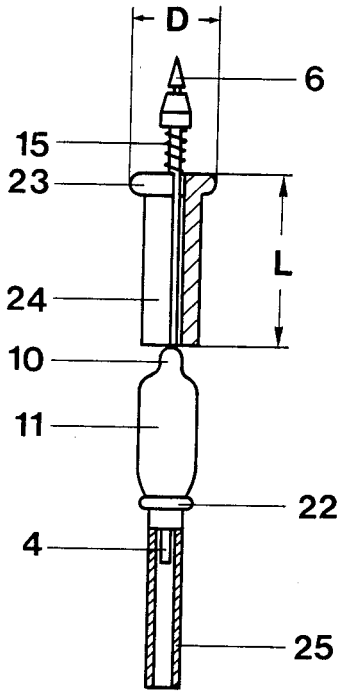
FIG. 2 illustrates essential portions of a second embodiment of the present invention, partially in section.

The manufacture and assembly of a discharge lamp according to the present invention is relatively simple, as described below for the cathode assembly. A glass member 10 is fused to the electrode portion 4. The glass member 10 has a graded, smaller coefficient of expansion than the tungsten material used in the electrode portion. Depending on the size of the lamp and its power input, the dome portion 11 to be applied subsequently to the glass portion 10 is comprised of one or several transition glasses whose respective coefficients of expansion become progressively lower. The last material to be applied is—like the beading 22, shown in FIG. 2—quartz glass. Subsequently, the end of the envelope portion 8 is fused to the beading 22. After construction of the dome 11 has been finished, the support element 13 of quartz glass is slipped over the electrode portion 4. In the embodiment of the present invention illustrated in FIG. 2, the support element 24 has an enlarged shoulder 23 facing the discharge space and has a length L of about 20 mm and a maximum diameter D of approximately 10 mm. The ratio of the length L to the diameter D at the side facing the discharge space is approximately 2.0, which is considerably smaller than at the side facing away from the discharge space.

In either embodiment of the present invention, support elements fitted onto the respective electrodes may readily be shifted axially. However, the pressure springs 14 and 15 preferably formed of the same material as the electrode portions, that is tungsten, is slipped loosely over the respective electrode portions. The respective electrode 5 or 6 is then affixed to the free end of the electrode portion 3 or 4 with the pressure springs 14 or 15 being slightly compressed. The support elements, therefore, are urged continually against their respective glass members 10. The electrode assembly so constructed may then be slipped into the respective envelope portion to which it is fused in the conventional manner, after having been appropriately positioned in discharge space 2. Only the spacing between electrodes 5 and 6 needs to be adjusted when the anode side electrode assembly is sealed in the respective envelope portion 7. The projecting tube member 25 of quartz glass is provided for ease of assembly and is removed before further processing steps are carried out for finishing the lamp.

Various changes and modifications may be made, and features described in connection with any one of the embodiments may be used with any of the others, within the scope of the inventive concept.

We claim:

1. In an elongated high-pressure discharge lamp (1) including a glass envelope defining a discharge space (2) and envelope end portions (7, 8) extending away from said discharge space;

elongate electrode portions (3, 4) extending respectively through said envelope end portions (7, 8);

electrodes (5, 6) carried at the inner end portions of the electrode portions (3, 4), and spaced from one another within said discharge space (2);

means (9, 10, 11) for hermetically sealing outer end portions of the electrode portions (3, 4) in the envelope end portions (7, 8);

a respective support element (12, 13) fitted around each said electrode portion (3, 4) in spaced relation with the envelope end portions (7, 8) each of said support elements (12, 13) having an inner end near the discharge space, and an outer end in the envelope end portions (7, 8);

and retaining means (14, 15) engaging said support elements (12, 13) for holding the support elements (12, 13) in the respective envelope end portions (7, 8);

wherein, said retaining means comprises resilient retaining elements (14, 15) engaging the inner end of the respective support element, each resilient retaining element being positioned between a respective electrode (5, 6) and the inner end of the respective support element (12, 13) for urging the outer end of the respective support element (12, 13) resiliently against a portion (9, 10) of said sealing means.

2. A high-pressure discharge lamp according to claim 1, wherein said support elements (12,13) each are of a length sufficient to extend from said sealing means (9,10) to said discharge space (2) to isolate the respective envelope portions (7,8) from said discharge space.

3. A high-pressure discharge lamp according to claim 1, wherein the ratio of the length of each support element (12,13) to its diameter is constant along the length thereof.

4. A high-pressure discharge lamp according to claim 2, wherein the ratio of the length of each support element (12,13) to its diameter is constant along the length thereof.

5. A high-pressure discharge lamp according to claim 1, wherein the portion (23) of the support element (12,13) adjacent the discharge space (2), has a diameter larger than remaining portions (24) of the support elements (12,13).

6. A high-pressure discharge lamp according to claim 2, wherein the portions (23) of the support element (12,13) adjacent the discharge space (2) has a diameter larger than remaining portions (24) of the support elements (12, 13).

7. A high-pressure discharge lamp according to claim 1, wherein the ratio of the length of the support element to its diameter is equal to at least one.

8. A high-pressure discharge lamp according to claim 2, wherein the ratio of the length of the support element (12,13) to its diameter is equal to at least one.

9. A high-pressure discharge lamp according to claim 3, wherein the ratio of the length of the support element (12,13) to its diameter is equal to at least one.

10. A high-pressure discharge lamp according to claim 4, wherein the ratio of the length of the support element (12,13) to its diameter is equal to at least one.

11. A high-pressure discharge lamp according to claim 5, wherein the ratio of the length of the support element (12,13) to its diameter is equal to at least one.

12. A high-pressure discharge lamp according to claim 6, wherein the ratio of the length of the support element (12,13) to its diameter is equal to at least one.

13. A high-pressure discharge lamp according to claim 1, wherein said support elements (12,13) are each formed of a material having a high melting point and a coefficient of thermal expansion similar to that of the material forming the glass enclosure.

14. A high-pressure discharge lamp according to claim 2, wherein said support elements (12,13) are each formed of a material having a high melting point and a coefficient of thermal expansion similar to that of the material forming the glass enclosure.

15. A high-pressure discharge lamp according to claim 1, wherein said resilient elements (14, 15) are formed of a material having a high melting point.

16. A high-pressure discharge lamp according to claim 15, wherein said material is tungsten.

17. A high-pressure discharge lamp according to claim 1, wherein the resilient elements (14, 15) are formed of the same material as that of the electrode portions (3, 4).

18. A high-pressure discharge lamp according to claim 1, wherein the glass enclosure is made of quartz glass;

and wherein said resilient elements (14, 15) are formed of a material having a high melting point.

19. A high-pressure discharge lamp according to claim 1, wherein said resilient elements are formed as spiral compression springs (14, 15) placed around the electrode portions (3, 4) and bearing against a respective electrode (5, 6) and the inner end of the respective support element (12, 13).

20. A high-pressure discharge lamp according to claim 1, wherein the glass enclosure is made of quartz glass;

said resilient elements are made of a material having a high melting point;

and wherein said resilient elements are formed as spiral compression springs (14, 15) placed around the electrode portions (3, 4) and bearing against a respective electrode (5, 6) and the inner end of the respective support element (12, 13).

* * * * *